US007152466B2

(12) United States Patent
Ramakrishnan et al.

(10) Patent No.: US 7,152,466 B2
(45) Date of Patent: Dec. 26, 2006

(54) METHODS AND APPARATUS FOR RAPIDLY MEASURING PRESSURE IN EARTH FORMATIONS

(75) Inventors: Terizhandur S. Ramakrishnan, Bethel, CT (US); Eric Donzier, Brookfield, CT (US)

(73) Assignee: Schlumberger Technology Corporation, Ridgefield, CT (US)

( * ) Notice: Subject to any disclaimer, the term of this patent is extended or adjusted under 35 U.S.C. 154(b) by 0 days.

(21) Appl. No.: 10/351,821

(22) Filed: Jan. 27, 2003

(65) Prior Publication Data

US 2004/0083805 A1 May 6, 2004

Related U.S. Application Data

(63) Continuation-in-part of application No. 10/285,788, filed on Nov. 1, 2002, now abandoned.

(51) Int. Cl.
*E21B 47/06* (2006.01)
*E21B 49/10* (2006.01)

(52) U.S. Cl. ..... 73/152.51; 73/152.26

(58) Field of Classification Search ..... 73/152.51, 73/152.01, 152.24, 152.26, 38, 152.05, 152.12; 175/48, 50

See application file for complete search history.

(56) References Cited

U.S. PATENT DOCUMENTS

| | | | | |
|---|---|---|---|---|
| 2,588,717 | A * | 3/1952 | Goodwin | 73/152.17 |
| 2,669,690 | A * | 2/1954 | Doll | 324/367 |
| 2,695,820 | A * | 11/1954 | Segesman | 166/241.5 |
| 2,747,401 | A * | 5/1956 | Doll | 73/152.05 |
| 2,892,501 | A * | 6/1959 | Boller | 166/100 |
| 3,181,608 | A * | 5/1965 | Palmer | 73/152.05 |
| 3,355,939 | A * | 12/1967 | Van Gils | 73/152.51 |
| 3,724,540 | A * | 4/1973 | Urbanosky et al. | 166/100 |
| 3,780,575 | A * | 12/1973 | Urbanosky | 73/152.26 |
| 3,859,851 | A * | 1/1975 | Urbanosky | 73/152.24 |
| 3,864,970 | A * | 2/1975 | Bell | 73/152.25 |
| 3,934,468 | A * | 1/1976 | Brieger | 73/152.25 |
| 4,285,398 | A * | 8/1981 | Zandmer et al. | 166/100 |
| 4,287,946 | A * | 9/1981 | Brieger | 166/100 |

(Continued)

FOREIGN PATENT DOCUMENTS

| | | |
|---|---|---|
| EP | 0 530 105 | 3/1996 |
| GB | 1 531 851 | 11/1978 |
| GB | 2 373 060 | 9/2002 |

*Primary Examiner*—Hezron Williams
*Assistant Examiner*—John Fitzgerald
(74) *Attorney, Agent, or Firm*—David P. Gordon; Jody Lynn DeStefanis; Dale Gaudier

(57) ABSTRACT

Methods and apparatus for rapidly measuring pressure in earth formations are disclosed. According to a first embodiment of the apparatus, a probe is provided with a movable piston having a sensor built into the piston. According to a second embodiment of the apparatus, the pressure sensor is mounted adjacent to or within the piston cylinder and a fluid pathway is provided from the sensor to the interior of the cylinder. Methods of operating the first and second embodiments include delivering the probe to a desired location in a borehole, setting the probe against the formation, and withdrawing the piston to draw down fluid for pressure sensing. A third embodiment of the probe is similar to the second but is provided with a spring loaded metal protector surrounding the cylinder and an annular rubber facing. The third embodiment is preferably used in a semi-continuous pressure measuring tool or an LWD tool having a piston controlled bowspring and a piston controlled articulated member carrying the probe. The tool is moved in a semi-set mode and when located at a desired depth is rapidly put in a fully-set mode.

30 Claims, 7 Drawing Sheets

U.S. PATENT DOCUMENTS 4,416,152 A * 11/1983 Wilson ..... 73/152.26
4,507,957 A * 4/1985 Montgomery et al. ... 73/152.26
4,513,612 A * 4/1985 Shalek ..... 73/152.24
4,860,581 A 8/1989 Zimmerman et al. ..... 73/155
4,893,505 A * 1/1990 Marsden et al. ..... 73/152.24
4,936,139 A 6/1990 Zimmerman et al. ..... 73/155
4,951,749 A * 8/1990 Carroll ..... 166/264
5,008,625 A * 4/1991 Chen ..... 324/351
5,159,828 A * 11/1992 Steiger et al. ..... 73/38
5,230,244 A * 7/1993 Gilbert ..... 73/152.17
5,233,866 A * 8/1993 Desbrandes ..... 73/152.05
5,302,781 A * 4/1994 Hanson, III ..... 181/102
5,473,939 A * 12/1995 Leder et al. ..... 73/152.12
5,770,798 A * 6/1998 Georgi et al. ..... 73/152.05
5,881,807 A * 3/1999 B.o slashed.e et al. ..... 166/100
6,164,126 A * 12/2000 Ciglenec et al. ..... 73/152.01
6,230,557 B1 * 5/2001 Ciglenec et al. ..... 73/152.01
6,729,399 B1 * 5/2004 Follini et al. ..... 166/264
6,837,314 B1 * 1/2005 Krueger et al. ..... 175/59
2002/0060094 A1 * 5/2002 Meister et al. ..... 175/50
2002/0185313 A1 * 12/2002 Jones et al. ..... 175/48

* cited by examiner

METHODS AND APPARATUS FOR RAPIDLY MEASURING PRESSURE IN EARTH FORMATIONS

This application is a continuation-in-part of U.S. patent application Ser. No. 10/285,788, filed Nov. 1, 2002, now abandoned assigned to the same assignee as the present application.

This application is related to co-owned U.S. Pat. Nos. 4,936,139 and 4,860,581, the complete disclosures of which are hereby incorporated by reference herein.

BACKGROUND OF THE INVENTION

1. Field of the Invention

The invention relates to the production of hydrocarbons from an underground formation. More particularly, the invention relates to testing earth formations to determine formation pressure.

2. State of the Art

The previously incorporated co-owned U.S. Patents describe technology used in the assignee's commercially successful borehole tool, the MDT (a trademark of Schlumberger). The MDT tool is a wireline tool which includes a packer and a probe which enable the sampling of formation fluids and the measuring of pressure transients during sampling or a pretest. One can infer formation permeability from a pressure transient. In addition, the formation pressure can be obtained with the MDT tool by extrapolation from the pressure transient or, preferably, by waiting long enough for the measured pressure transient to stabilize.

Prior art FIG. 1 illustrates an MDT tool as described in previously incorporated U.S. Pat. Nos. 4,936,139 and 4,860,581. The MDT tool 10 is shown in a borehole 12. The tool 10 includes an elongated body 14 that carries a selectively extendible fluid admitting assembly 16 and a selectively extendible tool anchoring member 18. The illustrated tool also has at least one fluid collecting chamber 20 which is coupled to the fluid admitting assembly 16 by a flow line bus 22. The fluid admitting assembly 16 includes a packer 24, a pair of pistons 26 and a front shoe 28 connecting the packer to the pistons. A filter 30 extends through the packer and the front shoe to a filter valve 32. The valve 32 is selectively fluidly coupled to the collecting chamber 20 by the flow line bus 22 which is also connected to a strain gauge 34, a crystal quartz gauge (CQG) 36, a resistivity/temperature cell 38, and a pretest chamber 40 via an isolation valve 42 and an equalizing valve 44.

In order to make accurate analyses of the formation, it is desirable to obtain many pressure measurements throughout different parts of the formation. In addition, because of the expense involved in keeping the MDT tool deployed in a borehole, it is desirable that measurements and samples be taken as quickly as possible. For high permeability formations, the MDT tool provides formation pressure measurements reasonably quickly, two to three minutes per point, much of this time being taken to anchor the tool. For low permeability formations, however, it may take several more minutes for the pressure to stabilize. It will be appreciated that the steps involved in taking pressure measurements include raising or lowering the tool to a desired location, extending the telescoping pistons and the packer to anchor the tool, extending the fluid collecting filter up to the wall of the formation, pumping to remove mud cake and ensure hydraulic communication with the formation, waiting for the pressure to stabilize, then retracting the packer and pistons before moving to the next measurement location.

SUMMARY OF THE INVENTION

It is therefore an object of the invention to provide methods and apparatus for rapidly measuring pressure in earth formations.

It is also an object of the invention to provide methods and apparatus for rapidly measuring pressure in earth formations having low permeability.

In accord with these objects that will be discussed in detail below, the apparatus of the present invention includes a piston driven probe having an integral or closely associated pressure sensor. It has been discovered that one of the reasons why the existing MDT tool and tools like it are slow to measure pressure is because they have voluminous flow lines with dead ends that are liable to trap other fluids. This is generally desirable in the MDT tool for the acquisition of fluid samples, but it makes pressure measurements time consuming due to the wait for the flow lines to adjust to the pressure.

According to a first embodiment of the invention, an hydraulically operated probe assembly is provided with an integral MEMS (microelectro mechanical system) or similar miniature pressure and temperature sensor. The probe assembly is designed to be used with the hydraulic system of an existing MDT tool. The probe assembly includes an hydraulically operated piston with the sensor embedded therein. A fluid pathway of sufficient tortuosity (e.g. a zig-zag path capable of holding viscous hydraulic fluid as a protector of the sensing diaphragm) is provided from the head of the piston to the sensor and is filled with a viscous hydraulic fluid. Alternatively, a less tortuous path is provided with a diaphragm which separates the hydraulic fluid from the formation fluids. The piston is preferably provided with an O-ring seal between it and the probe body.

According to a second embodiment of the invention, the sensor is not mounted in the piston but is mounted in the body of the probe and is coupled to a fluid pathway which terminates in an interior side wall of the piston cylinder. The piston is provided with an O-ring at a location which does not pass over the side wall terminus of the fluid pathway.

According to a third embodiment of the invention, a semi-continuous formation pressure tool is provided. An exemplary tool has a bow spring and a telescoping piston. The bow spring exerts a light force against the formation wall whose traveling force can be adjusted by the piston. For fully setting the tool, an inner piston capable of moving through a hole in the bow spring may be used. This allows the tool to travel in the nearly set mode with negligible time required to be placed in the fully set mode. This embodiment can also be adapted for use in a logging while drilling (LWD) tool.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
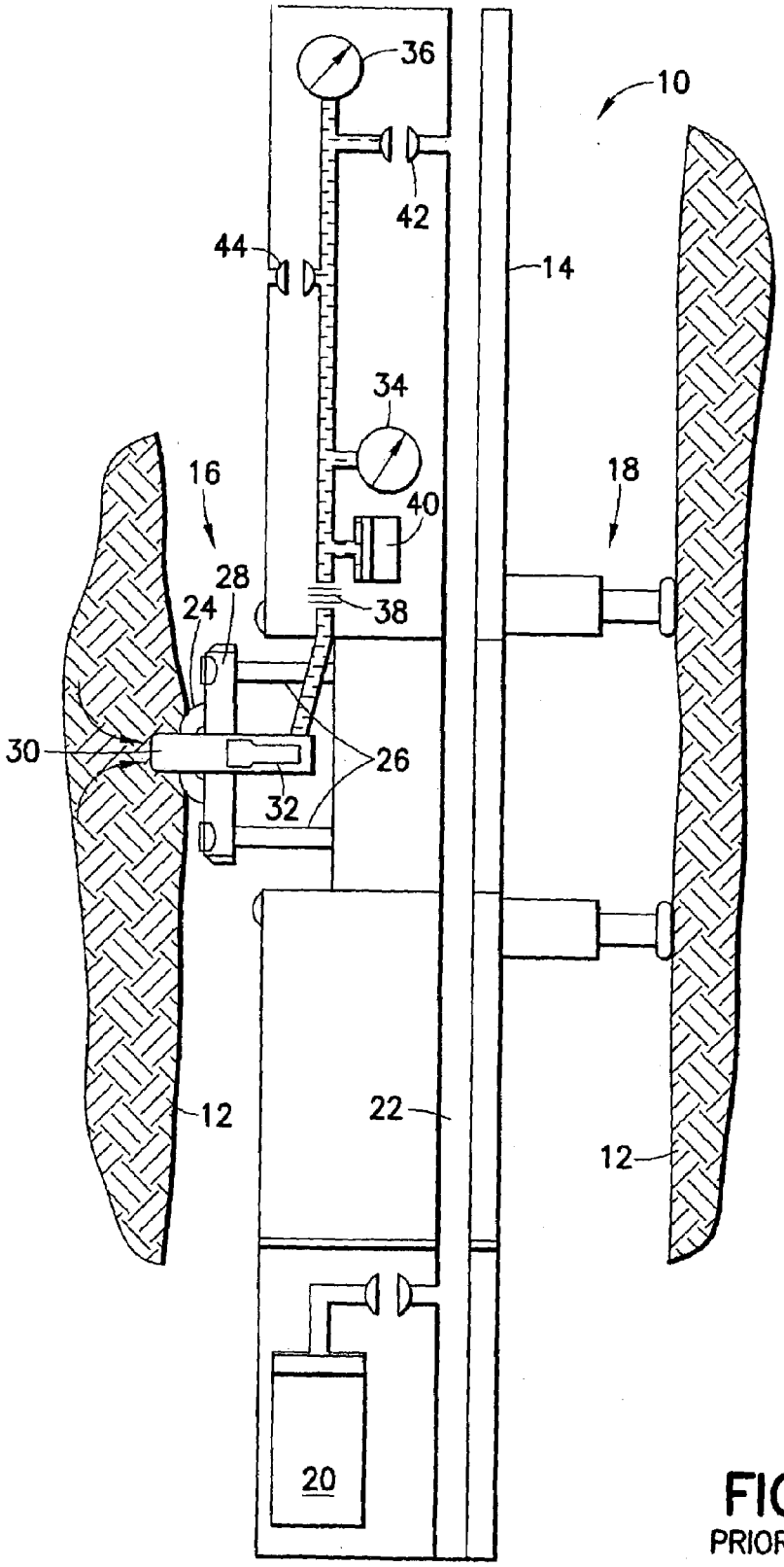
FIG. 1 PRIOR ART
FIG. 1 is a schematic view of a prior art MDT tool.
Figure 2:
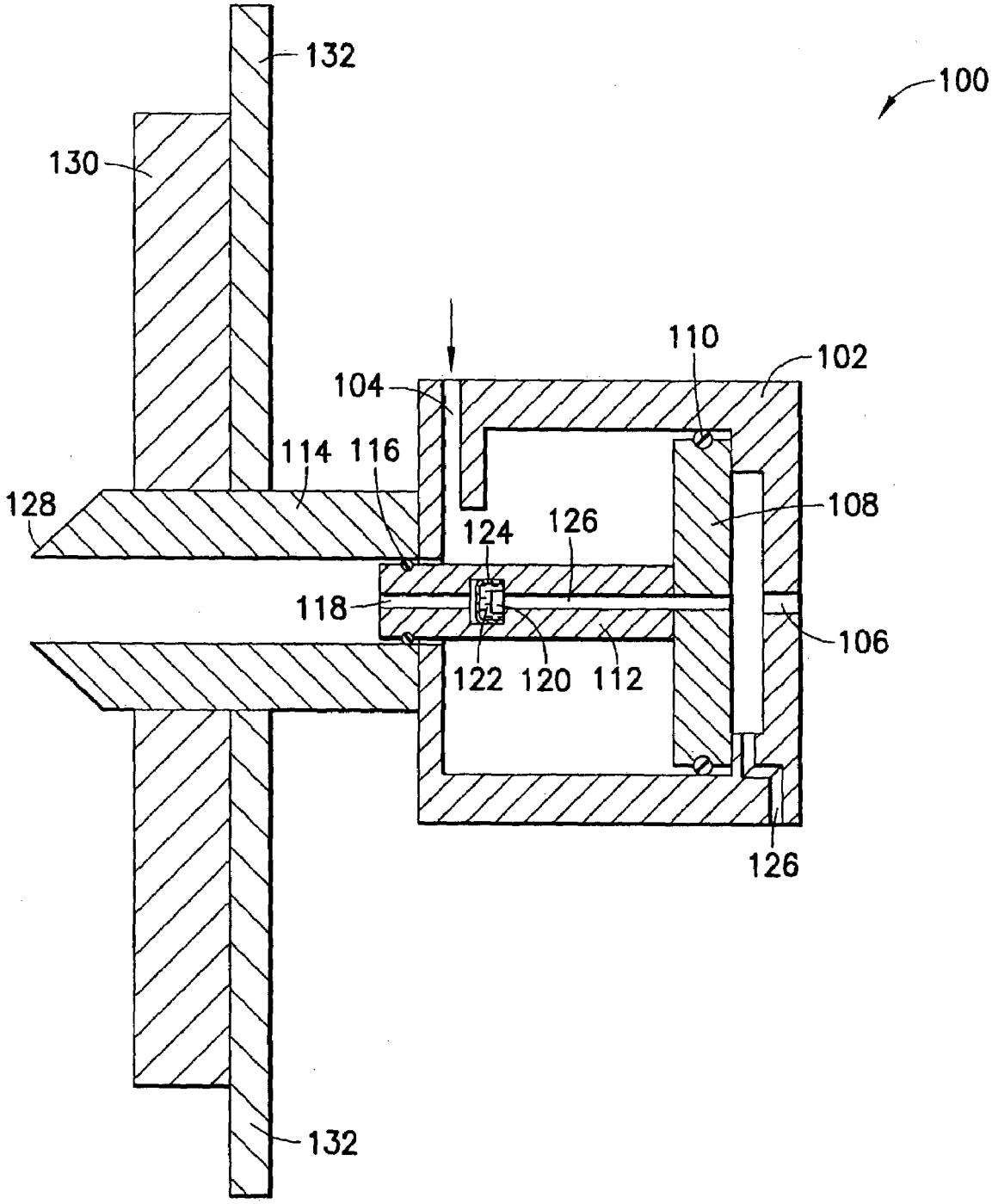
FIG. 2 is a schematic view of a first embodiment of a pressure sensing probe according to the invention.

Referring now to FIG. 2, the probe 100 includes an hydraulic cylinder 102 having a first fluid inlet 104 and a second fluid inlet 106 with a first piston 108 disposed therebetween. The fluid on either side of the piston 108 is sealed by an O-ring 110. A second piston 112, which is attached to or integral with the first piston 108, extends from the first piston 108 into a fluid cylinder 114 (attached to or integral with the hydraulic cylinder 102) and is sealed with an O-ring 116. The second piston 112 has a bore 118 which extends into a chamber within the piston containing a pressure sensor 120, covered with a fluid 122 and a diaphragm 124. An electrical cable connection 126 extends from the pressure sensor 120 through the pistons 112, 108 and out through the cylinder 102. The fluid cylinder 114 has a tapered end 128 for insertion into the formation. A packer 130 (illustrated schematically) is preferably mounted adjacent the cylinder 114 for moving the cylinder into and out of the formation. The packer is pushed via a metallic plate 132.

From the foregoing, those skilled in the art will appreciate that the introduction of hydraulic fluid into the inlet 106 will cause the pistons 108, 112 to be driven forward. Similarly, introduction of hydraulic fluid into the inlet 104 will cause the pistons to be driven back to the position shown in FIG. 2.

Figure 2A:
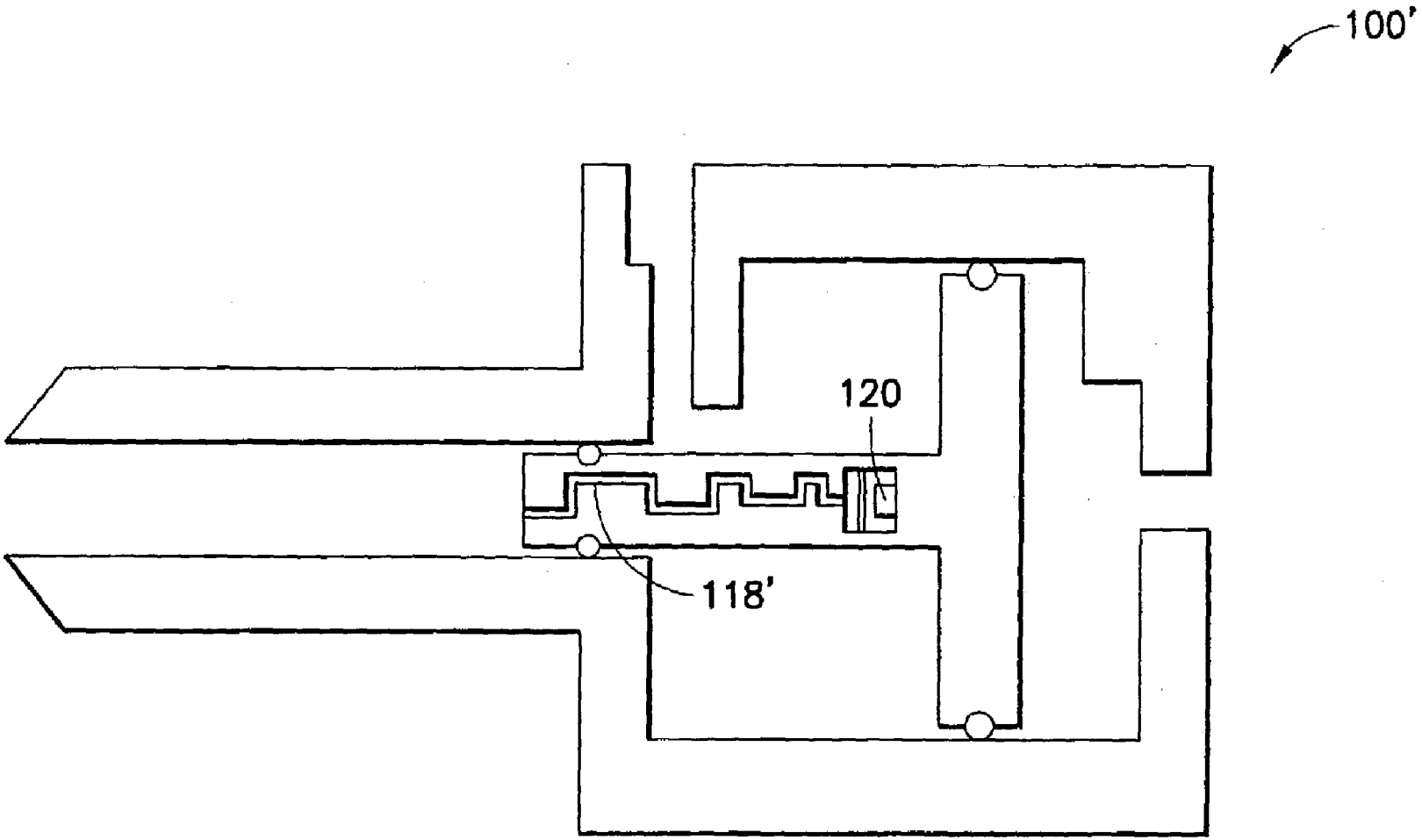
FIG. 2*a* is a schematic view of an alternate first embodiment of a pressure sensing probe according to the invention.

The probe 100 is designed to be used with an existing MDT hydraulic system which is utilized to set the packer(s), drive the probe into or against the formation, and move the pistons 108, 112. The sensor 120 is preferably a MEMS (microelectro mechanical system) and the fluid 122 is preferably silicone or Fomblin oil. FIG. 2*a* illustrates an alternate first embodiment 100' wherein a tortuous path 118' is provided in fluid communication with the sensor 120. The path 118' is preferably filled with a viscous oil.

According to the methods of the invention, the pistons 108, 112 are moved to the forward position (not shown) and the MDT tool is lowered or raised to the desired position. The MDT hydraulic system is operated to energize the setting pistons so that the MDT tool is rigidly held at a depth and the packer is set. The setting action is followed by a probe setting wherein the probe 100 is driven toward the formation so that the formation is engaged by the cylinder 114. This is followed by the withdrawal of the pistons 108, 112, stabilization of a pressure reading, and then retraction of the probe and the packer(s). The time required to make measurements may be reduced by having an automated algorithm that computes pressure as a function of spherical/cylindrical time functions. If the sequence converges to the same value one may decide to retract, in advance of reaching close to the formation pressure. In other words while extrapolating a final pressure from a series of measurements, one may decide that the extrapolated value is correct when additional measurements do not change the extrapolated value.

According to the methods described above, it is possible for software to extrapolate formation pressure based on spherical or cylindrical flow (knowing the retraction rate of the piston, or in the absence of which, specifying a rate pulse of known magnitude). The user may be allowed to override this option.

Equation (1) illustrates the spherical flow function $f_s$ as a function of flow time $T_f$ and time since flow was stopped $\Delta t$.

$$f_s = \left( \frac{1}{\sqrt{\Delta t}} - \frac{1}{\sqrt{T_f + \Delta t}} \right) \tag{1}$$

Equation (2) illustrates the cylindrical flow function $f_c$ as a function of flow time $T_f$ and time since flow was stopped $\Delta t$.

$$f_c = \ln\left( \frac{T_f + \Delta t}{\Delta t} \right) \tag{2}$$

In order to provide a good clean-up of the mudcake which will accumulate in the cylinder 114, an ultrasonic horn or an ultrasonic mudcake cleaner (not shown) may be included in the piston 112. By employing an ultrasound cleaner the adhesion of the mudcake to the formation can be reduced. In a preferred method, the ultrasonic device would be activated as the piston is withdrawn to ease the removal of the mudcake.

Although the presently preferred embodiment is to utilize the hydraulics of a modified MDT tool to operate the probe 100, it will be appreciated that an alternative to the hydraulic system is to activate the piston in one quick motion with an electromagnetic actuator. An advantage of the non-hydraulic system is that the flow rate is essentially a pulse of an extremely short duration. This allows for a reduction of the flowing period by several seconds. The force that may be exerted in such a system is about 100N. Given that the pressure differentials between the borehole and the formation fluid may lead to forces as high as 750N for the hydraulic probe, the non-hydraulic probe should have a diameter approximately one-fourth that of the hydraulic probe. In particular, the hydraulic probe should have a diameter of 1–2 cm and the non-hydraulic probe should have a diameter of 0.25–0.5 cm.

Figure 3:
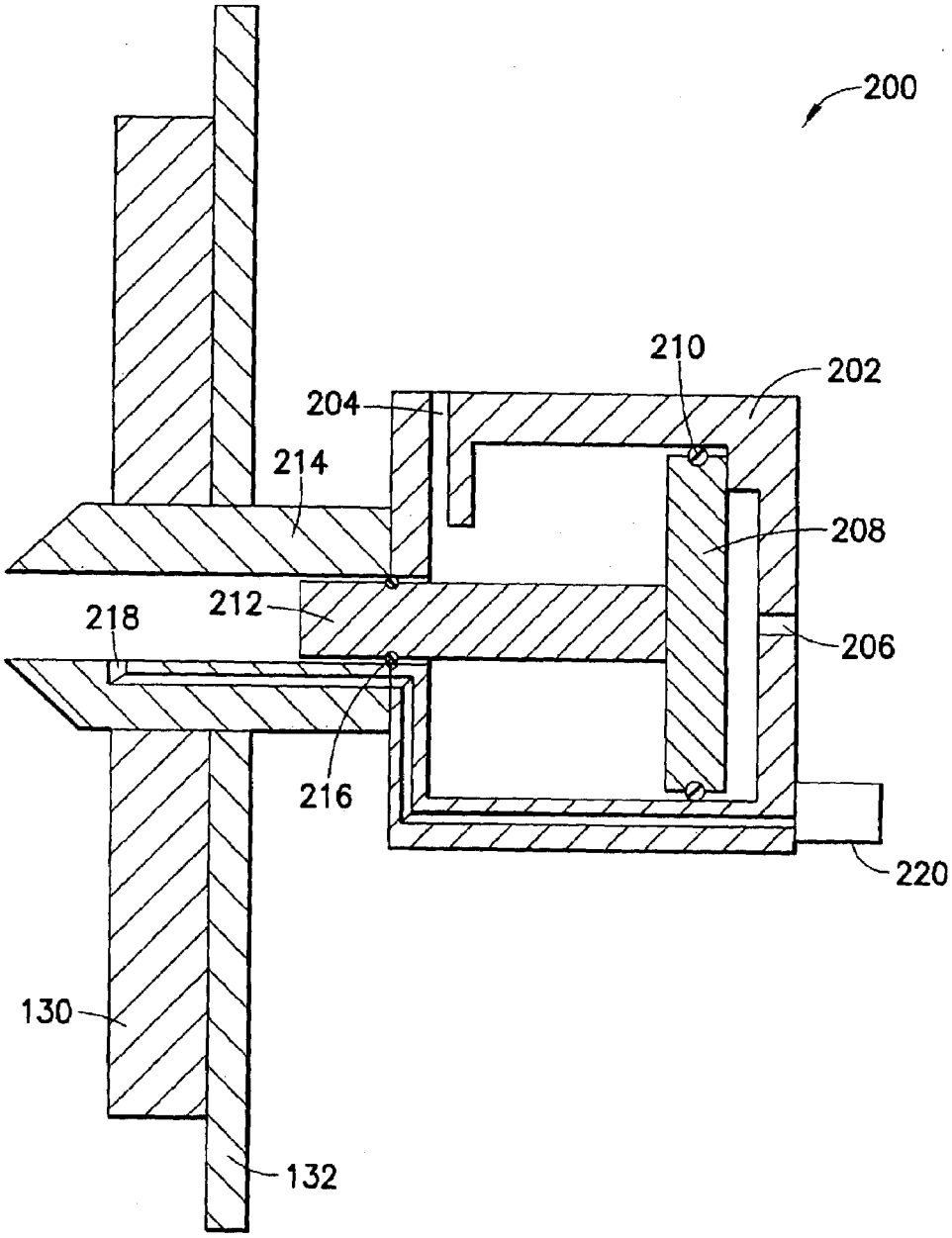
FIG. 3 is a schematic view of a second embodiment of a pressure sensing probe according to the invention.

FIG. 3 shows an alternate embodiment of a probe 200 which is similar to the probe 100 with similar reference numerals (increased by 100) referring to similar parts. In this embodiment, a larger sensor 220 (e.g. quartz guage or strain gauge such as a sapphire strain gauge) rather than a smaller MEMS sensor (120 in FIG. 2) is mounted adjacent to the cylinder 202. A fluid pathway 218 extends from the sensor 220 into the cylinder 214. The location of the outlet of the pathway 218 is selected such that it is not crossed by the O-ring 216 of the piston 212. This embodiment allows the use of sensors which are too large to be built into the body of a piston. The operation of the probe 200 is substantially the same as the operation of the probe 100 described above.

It may be advantageous for the fluid pathway 218 to be provided with slits (e.g. a screen, not shown) to prevent the entry of mud particles. The mud caught by the screen is then dislodged as the piston 212 moves forward. According to an alternative embodiment, the pressure sensor 220 can be mounted inside the body of the cylinder 202, thus shortening the length of the fluid path 218.

Figure 4:
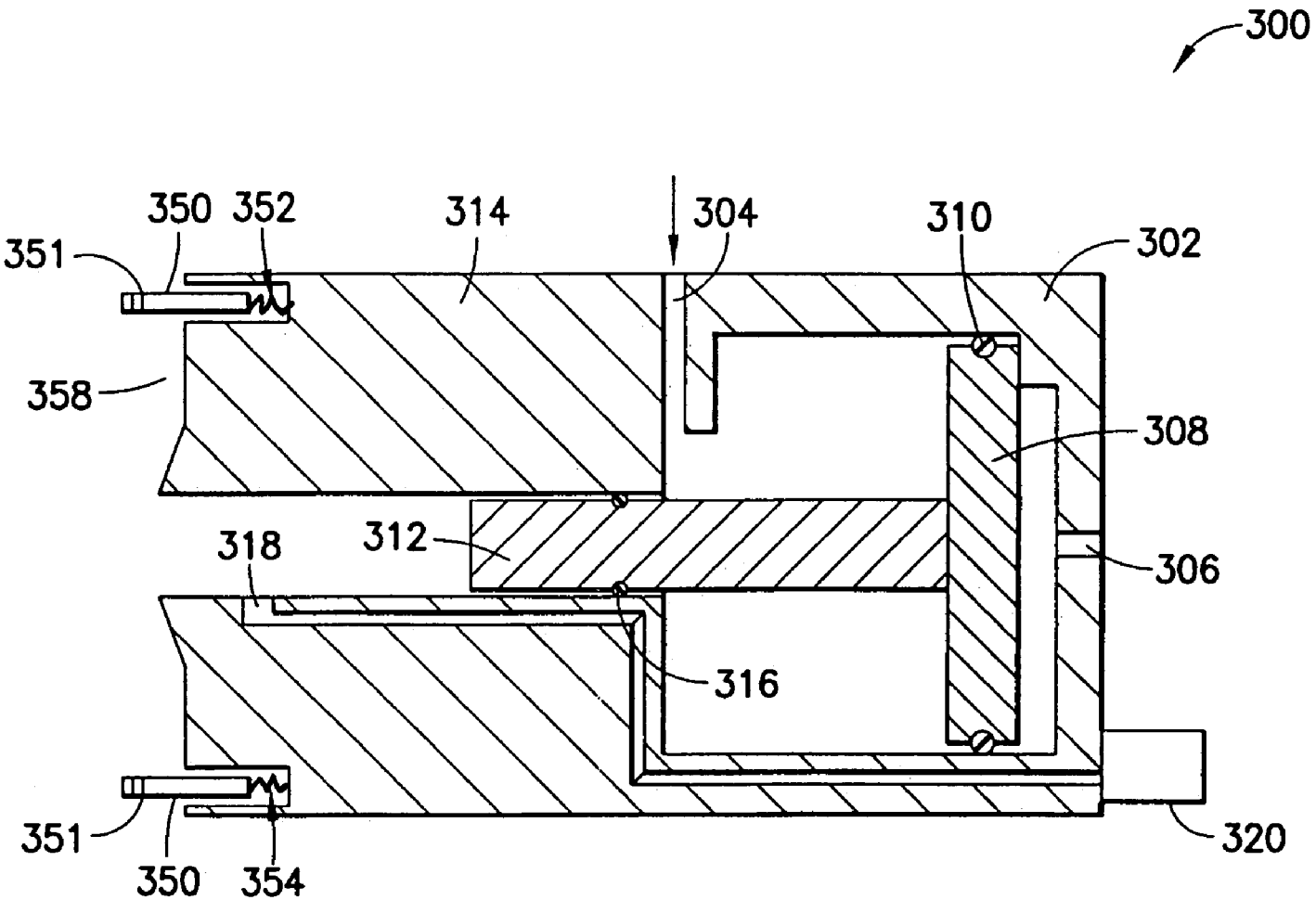
FIG. 4 is a schematic view of a third embodiment of a pressure sensing probe according to the invention.
Figure 5:
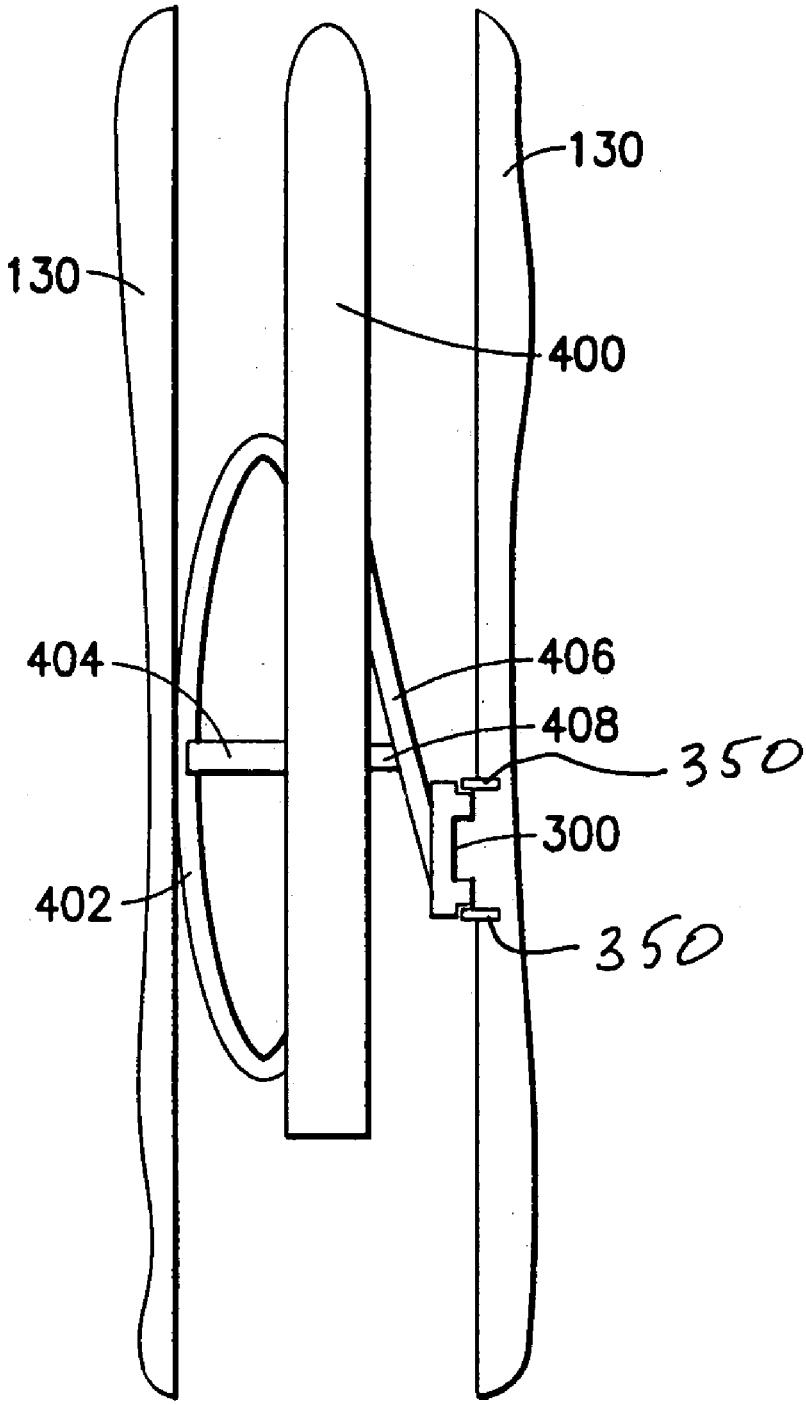
FIG. 5 is a schematic view of a semi-continuous formation pressure tool according to the invention.

FIGS. 4 and 5 illustrate a probe 300 and a tool 400, respectively, for semi-continuous formation pressure testing. The probe 300 is similar to the probe 200 with similar reference numerals (increased by 100) referring to similar parts. According to this embodiment, the cylinder 314 has a diameter substantially equal to the cylinder 302 and is provided by a cylindrical metal protector 350 biased by one or more springs 352, 354. The annulus inside the metal protector 350 is covered with a rubber facing 358. The spring constant of the spring(s) 352 (354) is such that the metal protector 350 protects the rubber facing 358 when the probe 300 travels through the borehole. Once a desired depth is reached, the probe 300 is moved toward the formation against the action of the spring(s) 352 (354) until the rubber facing 358 of the cylinder 314 is pressed sufficiently against the formation. The pistons 308, 312 are then operated as described above.

FIG. 5 illustrates a tool 400 which incorporates a probe 300 as described above. The tool 400 includes a bowspring 402 coupled to a first piston assembly 404 and an articulated assembly 406 coupled to a second piston 408. The probe 300 is coupled to the end of the articulated assembly 406. The assembly 406 and the bowspring 402 are preferably mounted approximately 180 degrees apart.

Figure 5A:
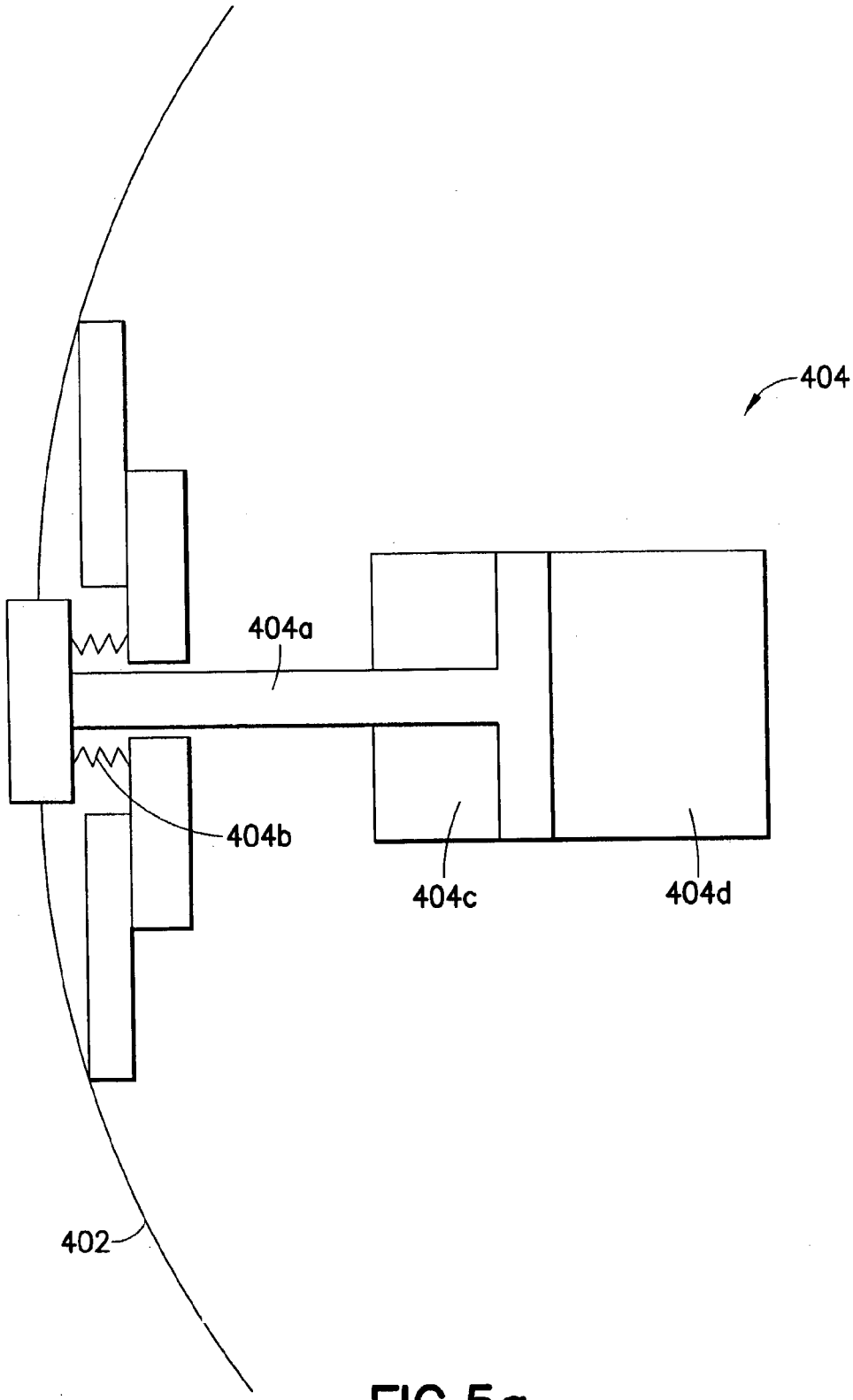
FIG. 5*a* illustrates more detail of an embodiment of the piston and bow spring of FIG. 5.

As illustrated in FIG. 5*a*, the piston assembly 404 includes a piston 404*a* surrounded by springs 404*b* and a piston cylinder 404*c*, 404*d*. Filling cylinder 404*c* and draining 404*d* retracts the piston. Filling 404*d* while draining 404*c* extends the piston.

According to the method of operating the tool 400, the pistons 404 and 406 are adjusted such that the bowspring 402 and the metal protector of the probe 300 exert light pressure against the formation 130 when the tool is being lowered into (raised out of) the borehole. The amount of pressure exerted should be sufficiently low to prevent damage to the bowspring and the probe. Once a desired location is reached for a pressure measurement, the pressure exerted by the pistons 404, 408 is increased and the tool is rapidly set. To do this, the piston arrangement may be allowed to travel through a hole in the bow spring as shown in FIG. 5*a* to directly exert a large force on the borehole wall. Once the tool is set, the pistons 308, 312 are operated in the manner described above.

The tool 400 has the advantage that rapid travel is accomplished in an "almost set mode" and thus the setting time is reduced. Emptying the probe 300 by moving the piston forward may be accomplished while the tool 400 is in travel. By lowering the hydraulic setting force during travel, a clear pathway for the fluid to be ejected from the probe to the borehole may be created. To facilitate this even further, the metal protector 350 around the rubber facing 358 may be provided with radial holes 351 to provide a fluid pathway during fluid ejection.

The "semi-continuous" tool 400 is also adaptable to the logging-while-drilling (LWD) environment. When used in an LWD application, it may be advisable to provide the tool with additional safety features. For example, it may be preferable that the drill string only be rotated when the probe and the bowspring are fully-retracted. In anticipation of a measurement, the tool may run on an almost-set mode and then at the time of measurement on a fully-set mode.

The concepts of the tool 400 may be extended to include multiple arms with probes to provide several pressure measurements along the tool length. In this case, automatic normalization and calibration of the pressure sensors with respect to each other, by using all of the borehole pressure data while the probes are in a borehole reading mode (fully retracted if necessary) is recommended.

There have been described and illustrated herein several embodiments of methods and apparatus for rapidly measuring pressure in earth formations. While particular embodiments of the invention have been described, it is not intended that the invention be limited thereto, as it is intended that the invention be as broad in scope as the art will allow and that the specification be read likewise. It will therefore be appreciated by those skilled in the art that yet other modifications could be made to the provided invention without deviating from its spirit and scope as so claimed.

The invention claimed is:

1. A probe for use with a borehole tool for measuring pressure in an earth formation, said probe comprising:

a) a first piston cylinder having an end which is movable into contact with the formation;

b) a first piston movable within said first piston cylinder; and c) a pressure sensor in fluid communication with said first piston cylinder, wherein said pressure sensor is mounted inside and fixed to said first piston, with said fluid communication being provided by a bore in the first piston.

2. A probe according to claim 1, wherein:

said sensor is a MEMS sensor.

3. A probe for use with a borehole tool for measuring pressure in an earth formation, said probe comprising:

a) a first piston cylinder having an end which is movable into contact with the formation;

b) a first piston movable within said first piston cylinder;

c) a pressure sensor in fluid communication with said first piston cylinder; and d) an electrical conductor which extends through said first piston and is coupled to said sensor.

4. A probe according to claim 3, further comprising:

e) a second piston coupled to said first piston;

f) a second piston cylinder within which said second piston is movably mounted, wherein movement of said second piston within said second piston cylinder causes movement of said first piston within said first piston cylinder.

5. A probe according to claim 4, wherein said second piston defines first and second fluid chambers in said second piston cylinder, each of said fluid chambers being provided with a fluid valve such that fluid entering said first fluid chamber and exiting said second fluid chamber causes said second piston to move in a first direction, and fluid entering said second fluid chamber and exiting said first fluid chamber causes said second piston to move in a second direction.

6. A probe according to claim 4, further comprising:

an O-ring surrounding said first piston sealing the space between said first piston and said first piston cylinder.

7. A probe according to claim 4, further comprising:

an O-ring surrounding said second piston sealing the space between said second piston and said second piston cylinder.

8. A probe for use with a borehole tool for measuring pressure in an earth formation, said probe comprising:

a) a first piston cylinder having an end which is movable into contact with the formation;

b) a first piston movable within said first piston cylinder;

c) a pressure sensor in fluid communication with said first piston cylinder; and d) a spring biased metal protector surrounding said first piston cylinder.

9. A probe according to claim 8, further comprising:

an O-ring surrounding said first piston sealing the space between said first piston and said first piston cylinder.

10. A probe according to claim 8, wherein:

said spring biased metal protector surrounding said first piston cylinder defines an annulus between said first piston cylinder and said spring biased metal protector.

11. A probe according to claim 10, further comprising:

d) an elastic facing disposed in said annulus.

12. A probe according to claim 11, wherein:

said elastic facing is rubber.

13. A borehole tool, comprising:

a) a tool body;

b) a pressure probe coupled to said tool body; and c) a spring coupled to said tool body allowing said tool to travel through a borehole in a semi-set mode, wherein said pressure probe includes i) a first piston cylinder having an end which is movable into contact with the borehole formation;

ii) a first piston movable within said first piston cylinder; and iii) a pressure sensor in fluid communication with said first piston cylinder, wherein said pressure sensor is mounted inside and fixed to said first piston with said fluid communication being provided by a bore in the first piston.

14. A borehole tool according to claim 13, wherein:

said pressure probe further includes iv) an O-ring surrounding said first piston sealing the space between said first piston and said first piston cylinder.

15. A borehole tool according to claim 13, wherein:

said spring comprises a bow spring.

16. A borehole tool according to claim 15, further comprising:

a first setting piston coupled to said bow spring.

17. A borehole tool according to claim 16, further comprising:

an articulated assembly coupled to said tool body and to said pressure probe.

18. A borehole tool according to claim 17, further comprising:

a second setting piston coupled to said articulated assembly.

19. A borehole tool according to claim 13, wherein:

said pressure probe further includes iv) a spring biased metal protector surrounding said first piston cylinder.

20. A borehole tool according to claim 19, wherein:

said spring biased metal protector surrounding said first piston cylinder defines an annulus between said first piston cylinder and said spring biased metal protector.

21. A borehole tool according to claim 20, wherein:

said pressure probe further includes v) an elastic facing disposed in said annulus.

22. A borehole tool according to claim 21, wherein:

said elastic facing is rubber.

23. A borehole tool according to claim 13, wherein:

said pressure probe further includes iv) a second piston coupled to said first piston; and v) a second piston cylinder within which said second piston is movably mounted, wherein movement of said second piston within said second piston cylinder causes movement of said first piston within said first piston cylinder.

24. A borehole tool according to claim 23, wherein said second piston defines first and second fluid chambers in said second piston cylinder, each of said fluid chambers being provided with a fluid valve such that fluid entering said first fluid chamber and exiting said second fluid chamber causes said second piston to move in a first direction, and fluid entering said second fluid chamber and exiting said first fluid chamber causes said second piston to move in a second direction.

25. A borehole tool according to claim 23, wherein:

said second piston cylinder is mounted proximate said first piston cylinder and said pressure sensor is mounted proximate said second piston cylinder with said fluid communication being provided by a bore extending through the walls of said first piston cylinder and said second piston cylinder.

26. A borehole tool according to claim 23, wherein:

said pressure probe further includes vi) an O-ring surrounding said second piston sealing the space between said second piston and said second piston cylinder.

27. A probe for use with a borehole tool for measuring pressure in an earth formation, said probe comprising:

a) a piston cylinder having an end which is movable into contact with the formation;

b) a piston movable within said piston cylinder;

c) a pressure sensor mounted within and fixed to said piston in fluid communication with said piston cylinder; and d) a protective barrier located between said pressure sensor and said piston cylinder.

28. A probe according to claim 27, wherein:

said protective barrier includes a viscous hydraulic fluid.

29. A probe according to claim 28, wherein:

said viscous hydraulic fluid is contained in a tortuous fluid path.

30. A probe according to claim 28, wherein:

said protective barrier further includes a diaphragm located between said viscous hydraulic fluid and said first piston cylinder.

* * * * *